United States Patent [19]

Caenazzo

[11] 4,160,606

[45] Jul. 10, 1979

[54] PAPER FEED MECHANISM FOR MULTIPLE COPY PRINTER

[75] Inventor: Santo Caenazzo, Rho, Italy

[73] Assignee: Honeywell Information Systems Italia, Italy

[21] Appl. No.: 777,985

[22] Filed: Mar. 14, 1977

Related U.S. Application Data

[63] Continuation of Ser. No. 610,362, Sep. 4, 1975, abandoned.

[30] Foreign Application Priority Data

Sep. 27, 1974 [IT] Italy ..... 27802 A/74

[51] Int. Cl.[2] ..... B41J 15/20

[52] U.S. Cl. ..... 400/616.2; 400/611

[58] Field of Search ..... 197/133 R, 133 P; 226/74, 75, 195; 400/611, 616, 616.1, 616.2, 616.3

[56] References Cited

U.S. PATENT DOCUMENTS

| | | | |
|---|---|---|---|
| 1,169,318 | 1/1916 | Cooper | 197/133 R |
| 2,302,704 | 11/1942 | Mabon | 197/133 P |
| 2,400,226 | 5/1946 | Euth | 197/133 P |
| 2,650,090 | 8/1953 | Davidson et al. | 197/133 R X |
| 3,880,016 | 4/1975 | Jamieson et al. | 74/405 |
| 3,902,584 | 9/1975 | Lee et al. | 197/133 R X |

FOREIGN PATENT DOCUMENTS

| | | | |
|---|---|---|---|
| 2233095 | 1/1974 | Fed. Rep. of Germany | 197/133 R |
| 825154 | 12/1959 | United Kingdom | 197/133 P |
| 848918 | 9/1960 | United Kingdom | 197/133 P |

*Primary Examiner*—Paul T. Sewell

*Attorney, Agent, or Firm*—Lewis P. Elbinger

[57] ABSTRACT

A paper feed mechanism for multiple copy, impact-type printers used in data processing systems, wherein both the platen and the paper advancement tractors are positively driven to avoid tearing of the paper and clogging of the feed mechanism.

6 Claims, 3 Drawing Figures

PAPER FEED MECHANISM FOR MULTIPLE COPY PRINTER

This is a continuation of application Ser. No. 610,362 filed Sept. 4, 1975 abandoned.

BACKGROUND OF THE INVENTION

This invention relates to a paper feed mechanism for multiple copy printers and, more particularly, to high-speed impact printers, teleprinters, and similar equipment used in data processing systems.

In such printers, a continuous paper web having rows of perforations along its edges is commonly employed as the print-receiving member. The advancement, or slewing, of the paper web is provided by sprocket tractors which engage the perforations at the edge of the web.

The tractors are intermittently actuated by escapement devices or, preferably, by stepping motors or low inertia motors, to provide on command, the advancement of the web after each printing of a line has been completed. In order to assure that proper paper web tension is provided proximate the print line, two pairs of tractors are usually used, one pair being placed upstream of the print line and the other downstream.

In these printers, a platen, in the form of a freely rotating cylinder, is aligned in correspondence with the print line. Therefore, instead of the tractor configuration described above, in another type of feed mechanism, the web is wrapped about the platen through an arc of approximately 180° and a single pair of tractors engages the web perforations both upstream and downstream of the platen.

However, in paper feed mechanisms of this latter type, if the print-receiving member consists of multiple copies, a relative shift occurs among the individual sheets of paper which form the web. This shift is particularly pronounced with respect to the sheet in contact with the platen. Consequently, in the region of the downstream tractor (relative to the direction of advancement of the web), the sprocket holes frequently tear, thereby resulting in clogging of the feed mechanism and an extremely irregular advancement of the web.

Accordingly, it is the object of the instant invention to obviate the aforementioned disadvantages of the prior art paper feed mechanisms.

Another object of the instant invention is to provide a paper feed mechanism for a printer used in data processing systems which is reliable, inexpensive, and consistent in performance.

Another object of the instant invention is to provide a reliable and inexpensive printer paper feed mechanism for use with multiple copy print-receiving members.

SUMMARY OF THE INVENTION

In accordance with the instant invention, the aforementioned objects are achieved by providing a paper feed mechanism in which the platen is mechanically coupled to the paper advancement tractors. Such mechanical coupling is provided to the extent required to impart a peripheral speed to the platen cylinder which is equal to or slightly greater than the peripheral speed of the tractors. According to another feature of the instant invention, the aforementioned mechanical coupling is provided by an elastic transmission member in order to reduce the inertial load applied to the motor that actuates the tractors.

BRIEF DESCRIPTION OF THE DRAWING

The invention will be described with reference to the accompanying drawing, wherein.

DESCRIPTION OF THE PREFERRED EMBODIMENT

Figure 1:
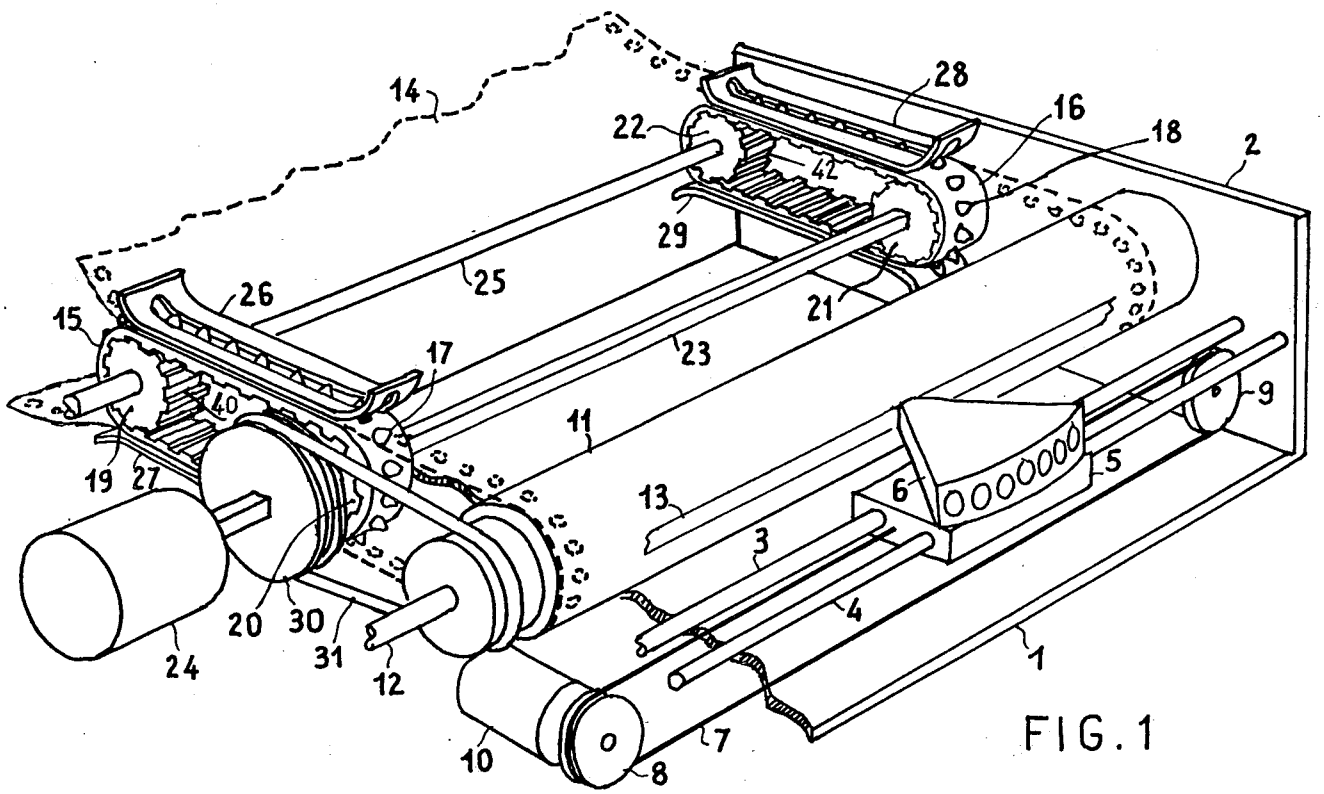
FIG. 1 is a perspective view of a printer provided with a feed mechanism embodied according to the instant invention.

The printer of FIG. 1 is a line printer of mosaic type. The printer comprises a frame, a print mechanism, and a paper feed mechanism.

The frame comprises a base 1 and a pair of side plates 2, only one of which is shown. The print mechanism is mounted on such frame.

One embodiment of the print mechanism comprises a pair of guide bars 3 and 4 and a printing carriage 5 slidably mounted on guide bars 3 and 4. A print head 6 is mounted on carriage 5.

The form of print head 6 employed in the embodiment illustrated in FIG. 1 is of the kind referred to as a "needle-head." The needle-head form of print head provides for the printing of different characters through a dot composition technique, which technique consists of the selective energization of different ones of the plurality of needles which comprise the print head, combined with the transverse movement of the print head and carriage.

However, consistent with the principles of the instant invention, different types of print mechanism may be employed.

A flexible transmission cable 7, affixed to carriage 5 and wound on a driving pulley 8 and an idler pulley 9 imparts to carriage 5 its necessary movement. Driving pulley 8 is affixed to the drive shaft of a motor 10, which may be a stepping motor or a low inertia d-c motor in order to control the movement of carriage 5 and print head 6 in either a continuous or intermittent manner, and in either direction along the print line according to the required modes of energization of print head 6. The corresponding and appropriate energization of motor 10 is controlled by appropriate electronic circuits.

Accordingly, print head 6 moves along a generatrix of an impact cylinder, or platen 11. Platen 11 is freely rotatable on a shaft 12.

An inked ribbon 13 is disposed between print head 6 and platen 11. Ribbon 13 is drawn from a first spool, and wound onto a second spool, neither spool being shown in FIG. 1

A continuous print-receiving member, or web 14, illustrated by dashed lines in FIG. 1, is wound about platen 11 through an arc of approximately 180°. Web 14 is provided with a row of perforations parallel to and proximate each edge. Web 14 may comprise a plurality of sheets of paper with sheets of carbon paper interleaved; however, instead of carbon paper, pressure-sensitive paper may be employed. If the printing is not effected by the impact technique, other types of print-receiving members may be employed. For example, if the printing is effected by the thermal technique, thermal-sensitive paper or other appropriate sheets of material may be used.

The advancement of web 14 is provided by the feed mechanism of the instant invention. Such feed mechanism comprises a pair of sprocket tractors, shown generally by the reference numerals 40 and 42. Sprocket tractors 40 and 42 are provided with respective belts, or chains, 15 and 16. Belt 15 is provided with external sprockets 17 and belt 16 is provided with external sprockets 18. Belt 15 is provided with internal teeth that engage with gears 19 and 20 and belt 16 is provided with internal teeth that engage with gears 21 and 22.

Gears 20 and 21 are mortised on a drive bar 23, which is actuated by a stepping, or low inertia, motor 24. Gears 19 and 22 are mounted to be freely rotatable and slidable on a shaft 25. Gears 19 and 20, together with belt 15, are fixed in a pre-established axial position by means of a frame or cage, not shown. Such cage is also employed as a support for a pair of pressure shoes, upper shoe 26 and lower shoe 27. On the other hand, gears 21 and 22, together with belt 16, are mounted in a cage which allows axial movement along drive bar 23 and shaft 25, and which bears a pair of pressure shoes 28 and 29.

With such an arrangement of a fixed and a movable cage, the distance between the two sprocket tractors is adjustable to match the width of web 14. Web 14 engages with the lower portion of sprocket tractors 40 and 42 by being interposed between belts 15 and 16 and respective lower shoes 27 and 29. Web 14 engages with the upper portion of sprocket tractors 40 and 42 by being interposed between belts 15 and 16 and the respective upper shoes 26 and 28. In this manner, web 14 is positively driven in either direction with respect to platen 11, both upstream and downstream of platen 11 and the print line. The feed mechanism by so driving the web assures adequate and proper paper tension without the need to resort to braking devices. This feature is particularly valuable, and necessary, in the instance wherein bidirectional movement of web 14 is required in order to perform corrections or to plot diagrams; i.e., to employ the printer as a "plotter."

In accordance with the instant invention, platen 11 is mechanically coupled to the tractors in order that the movement of the tractors causes rotation of the platen. With such coupling, the platen follows the web as it advances.

According to one embodiment of the instant invention, mechanical coupling between the tractors and platen is provided by a grooved pulley 30 affixed to drive bar 23 and by a belt 31 which couples pulley 30 to platen 11. For achieving the objectives of the invention, it is required that the peripheral speed imparted to platen 11 be equal to or, preferably, slightly greater than the speed of the tractors, the reason for such requirement being provided hereinafter. Accordingly, the diameter of pulley 30 is appropriately selected with respect to the diameter of platen 11.

In an alternative form of the invention, as shown in FIG. 1, belt 31 may be wound on an end portion of platen 11, which end portion has a diameter smaller than that of platen 11 and a diameter, with respect to that of pulley 30, which provides a peripheral speed of platen 11 slightly greater than the peripheral speed of tractors 40 and 42.

The mechanical coupling between tractors and platen may be provided by toothed belts or transmissions chains engaging with gears, instead of the form of coupling shown in FIG. 1.

According to another feature of the invention, the mechanical coupling between tractors and platen is provided by means of a resilient belt; i.e., a belt of rubber. Such form of coupling provides a number of advantages: on one hand, it eliminates the need of belt-tensioning devices and, on the other hand, it enables the adjustment of the distance between the platen and the tractors.

Thus, it is known that the relative distance between the print head and the platen must be adjusted according to the thickness of the web, the strength of the printing impact, and the number of copies to be printed. Although this may be accomplished by moving the print head, for example by mounting the print head on a slidable device, this is accomplished preferably, with simpler mechanisms, by moving the platen relative to the tractors and the print head. Moreover, by so moving the platen, another advantage is realized, that of providing for a reduction in the distance between platen and tractors to compensate, in part, for the longer path which a web of greater thickness must follow, which aspect will be described in more detail hereinafter.

According to another aspect of the instant invention, the utilization of a resilient, or elastic, coupling between tractors and platen enables a related reduction in the inertial torque load on motor 24 due to platen 11, thereby enabling the more rapid starting and stopping of the web at uniform motor power.

The above-described advantages and additional features of the instant invention will now be described in more detail, with reference to the modes of operation illustrated in FIGS. 2 and 3.

Figure 2:
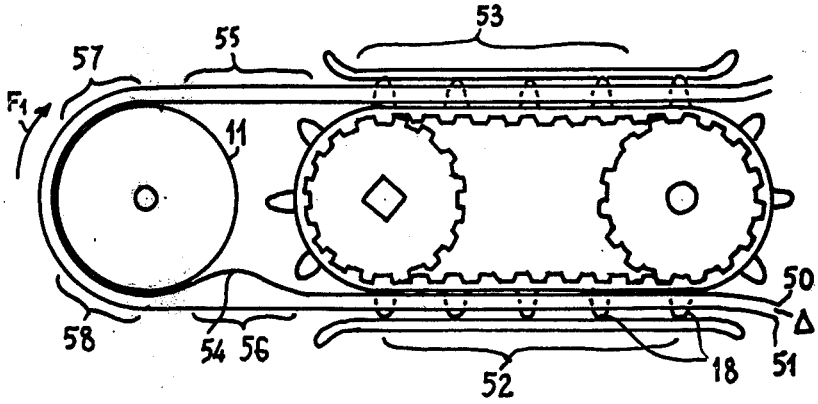
FIG. 2 PRIOR ART
FIG. 2 is an end view of a prior art paper feed mechanism, illustrating the disadvantages occurring in its operation.

The prior art paper feed mechanism illustrated in FIG. 2 advances a continuous print-receiving member, or web, comprising a plurality of sheets. Only inner sheet 50 and outer sheet 51 are illustrated in FIG. 2, the normal spacing between inner sheet 50 and outer sheet 51 being represented as equal to the distance $\Delta$.

The web engages sprockets 18 at a lower zone 52 and an upper zone 53, and is wound about freely rotatable platen 11 through an arc of approximately 180°. The direction of advancement of the web in FIG. 2 is represented by the arrow F1.

In order to assure good print quality, it is necessary that the web rest flat against platen 11. This is effected by subjecting the web to a definite, even though slight, tension. In its rest conditon, when the web is stationary, this tension is uniformly distributed over the entire portion of the web from the sprockets of lower zone 52 to the sprockets of upper zone 53. Such web portion has the same length of inner sheet 50 as outer sheet 51. However, the thickness of the web and its curvature around platen 11 result in a shorter length along the winding arc for inner sheet 50. Accordingly, inner sheet 50 actually will not be subjected to tension but, instead, will demonstrate a wrinkling 54 at least at one point along its path.

When, now, the paper feed mechanism is actuated, the inertia of platen 11 and the friction between platen 11 and the web result in a modification of the distribution of the tension applied to the web. Accordingly, the tension becomes greater in the web portion in the vicinity of zone 55 and weaker in the web portion in the vicinity of zone 56. The result of such redistribution of tension in the paper is that the contact pressure among the individual sheets of the web, and between web and platen 11, decreases from zone 57 to zone 58. Accordingly, relative shifting among the different sheets of the web occurs more easily at zone 58 that at zone 57. On the other hand, such shifting must necessarily occur along the arc through which the web is wound about platen 11 because the length of such arc is different for inner sheet 50 than for outer sheet 51. The consequences of such shifting are that platen 11 tends to transfer different lengths of inner and outer sheets along the length of such arc, and concentrates the length of the untransferred paper between lower zone 52 and platen 11, in the form of a wrinkling 54.

Another and more serious consequence of such shifting is that the resulting displacement among the sheets of the web is not recovered and, therefore, the web enters upper zone 53 with a relative displacement between the sheets. Accordingly, the perforations of inner sheet 50 are displaced with respect to, and do not register with, the perforations of outer sheet 51 and, as a result, are strongly stressed to tend to recover from such displacement. This results in a tearing of the paper of the web and a jamming of the web.

Figure 3:
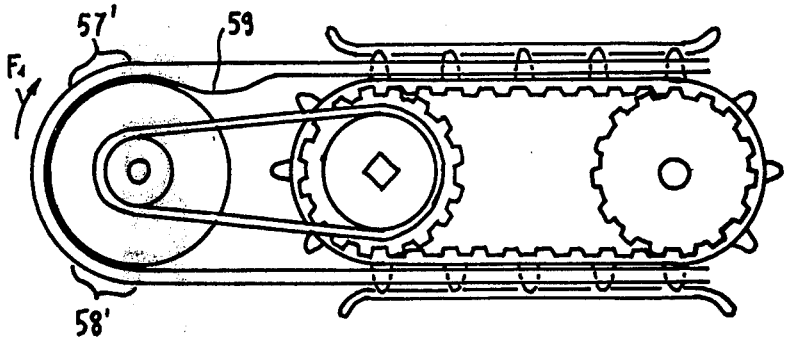
FIG. 3 is an end view of a paper feed mechanism embodied according to the instant invention, illustrating its mode of operation.

On the other hand, the paper feed mechanism of the instant invention, as illustrated in FIG. 3, provides for mechanically coupling the tractors to the platen to impart a peripheral speed to the platen at least equal to the speed of the tractors. This results in the platen providing a pulling effect on the web and, therefore, to a tension distribution in the web which is greater in the vicinity of zone 58' and weaker in the vicinity of zone 57'. This form of tension redistribution favors the necessary, and unavoidable, relative shifting among the different sheets of the web at zone 57', and the transfer of the wrinkling 54 to zone 59; i.e., between platen 11 and upper tractor zone 53.

In this manner, the perforations of the different sheets of the web are automatically realigned proximate to the sprockets and thereby prevent malfunctioning and paper tearing. In addition, by this mode of operation, the tension in the web at zone 59 is reduced, so that the risk of tearing of the web is further reduced, even though the tension in the web may be substantially borne by the outer sheet alone.

According to another aspect of the instant invention, this pulling action of the platen is further enhanced by adopting a transmission ratio which imparts to platen 11 a peripheral speed slightly greater than the peripheral speed of the tractors. This, on the one hand, results in an even further decrease in tension of the web at zone 59 and, on the other hand, enables the adoption of a resilient transmission, or coupling, between tractors and platen.

Utilization of the resilient coupling between tractors and platen provides for a certain amount of hysteresis during the acceleration of the platen, when the tractors commence advancement of the web, and during deceleration, when the tractors halt the advancement of the web. Accordingly, the inertial torque load on motor 24, FIG. 1 is reduced as compared to that with which it would be burdened in the instance of a rigid, or non-elastic, coupling.

While the principles of the invention have now been made clear in illustrative embodiments, there will be immediately obvious to those skilled in the art any modifications in structure, arrangements, the elements and components used in the practice of the invention, and otherwise, which are particularly adapted for specific environments and operating requirements, without departing from those principles. The appended claims are therefore intended to cover any such modifications, within the limits only of the true spirit and scope of the invention.

I claim:

1. In a printer provided with a cylindrical freely rotatable platen and a paper feed mechanism for advancing a continuous web which is wound about said platen through an arc of substantially 180°, said web comprising a plurality of superposed sheets, each of said sheets being provided with a row of perforations parallel to and proximate each edge thereof, wherein said paper feed mechanism comprises:

a pair of sprocket tractors for engaging simultaneously with said web in zones upstream and downstream of said platen, each of said tractors engaging one of said rows of perforations of all of said sheets of said web along a respective edge of said web in both of said zones, motor-actuated driving means engaging said pair of sprocket tractors to operate said tractors to advance said web in said zones, and coupling means for mechanically coupling said driving means to said platen for driving said platen with a rotational peripheral speed greater than the feeding speed of said tractors.

2. The paper feed mechanism of claim 1, wherein said coupling means provides resilient coupling.

3. A mechanism for advancing a continuous print-receiving web through a printer, comprising:

a rotatable cylindrical platen;

web drive means for engaging said web in zones both upstream and downstream of said platen when said web is partially wound about said platen, said web drive means urging said web toward said platen with a first speed in said upstream zone and pulling said web away from said platen with said first speed in said downstream zone; and a coupling member for coupling together said web drive means and said platen to provide a peripheral speed for said platen greater than said first speed.

4. The mechanism of claim 3, wherein said coupling member provides resilient coupling between said web drive means and said platen.

5. In a mechanism for advancing a continuous print-receiving web through a printer, said web comprising a plurality of perforated superposed sheets, the perforations of each of said sheets being provided in a row parallel to and proximate each edge thereof; wherein said web is partially wound about a freely rotatable cylindrical platen; and wherein web drive means engages said rows of perforations in all of said sheets of said web simultaneously over a flat zone upstream and a flat zone downstream of said platen, each such zone extending along the length of said web, said web drive means urging said web toward said platen with a first speed in said upstream zone and pulling said web away from said platen with said first speed in said downstream zone; the improvement comprising a coupling member for coupling together said web drive means and said platen to provide a peripheral speed for said platen greater than said first speed.

6. The mechanism of claim 5, wherein said coupling member provides resilient coupling between said web drive means and said platen.

* * * * *